US005521391A

United States Patent [19]

Bocian

[11] Patent Number: 5,521,391

[45] Date of Patent: May 28, 1996

[54] RADIOACTIVE MARKER

[75] Inventor: Sergio Bocian, Kibbutz Ma'ayan Zvi, Israel

[73] Assignee: Scopus Light (1990) Ltd., Kibbutz Ma'Ayan Zvi, Israel

[21] Appl. No.: 100,610

[22] Filed: Jul. 30, 1993

[30] Foreign Application Priority Data

Feb. 18, 1993 [IL] Israel ..... 104789

[51] Int. Cl.[6] ..... H01J 65/00

[52] U.S. Cl. ..... 250/493.1; 250/483.1; 250/496.1; 250/522.1; 362/84; 362/396

[58] Field of Search ..... 250/493.1, 458.1, 250/462.1, 486.1, 496.1, 483.1, 485.1, 527.1, 504 H; 362/34, 84, 396

[56] References Cited

U.S. PATENT DOCUMENTS

| | | | |
|---|---|---|---|
| 1,756,942 | 5/1930 | Eddy et al. | 362/396 |
| 2,287,109 | 6/1942 | Kollath | 362/396 |
| 2,330,561 | 9/1943 | Dietrich | 177/327 |
| 3,011,049 | 11/1961 | Kinghorn | 362/396 |
| 3,083,295 | 3/1963 | Baker | 240/59 |
| 4,285,029 | 8/1981 | McCoy | 362/84 |
| 4,524,279 | 6/1985 | Christianson et al. | 250/522.1 |
| 4,599,682 | 7/1986 | Stephens | 362/103 |
| 4,862,331 | 8/1989 | Hanabusa | 362/106 |
| 4,990,804 | 2/1991 | McNair | 250/493.1 |
| 5,043,851 | 8/1991 | Kaplan | 362/34 |
| 5,117,766 | 6/1992 | Nechushtan et al. | 116/209 |
| 5,118,951 | 6/1992 | Kherani et al. | 250/462.1 |
| 5,196,577 | 3/1993 | Shroot et al. | 562/490 |

FOREIGN PATENT DOCUMENTS

| | | |
|---|---|---|
| 359621 | 3/1990 | European Pat. Off. . |
| 476845 | 3/1992 | European Pat. Off. . |
| 755777 | 11/1933 | France . |
| 964201 | 7/1964 | United Kingdom . |

*Primary Examiner*—Bruce C. Anderson
*Assistant Examiner*—Kiet T. Nguyen
*Attorney, Agent, or Firm*—Ladas & Parry

[57] ABSTRACT

A radioactive marker including a housing and a light module disposed in the housing, the light module including a tritium light source disposed in a light source housing.

10 Claims, 3 Drawing Sheets

RADIOACTIVE MARKER

FIELD OF THE INVENTION

The present invention relates to illuminated markers generally.

BACKGROUND OF THE INVENTION

Various types of illuminated markers are known. These include electrically operated markers which may either be connected to mains or be battery operated. Chemically powered markers are also employed, but have very short operational duration. Radioactive markers are also known.

SUMMARY OF THE INVENTION

The present invention seeks to provide an improved radioactive marker.

There is thus provided in accordance with a preferred embodiment of the present invention a radioactive marker including a housing and a light module disposed in the housing, the light module including a tritium light source disposed in an acrylic housing.

Additionally in accordance with a preferred embodiment of the present invention the tritium light source is surrounded on at least one side by optical glue.

Further in accordance with a preferred embodiment of the present invention, white paint is provided on the back surface of the tritium light source to act as a reflector.

Alternatively in accordance with another embodiment of the present invention, white silicon is disposed adjacent the back of the tritium light source to act as a reflector.

BRIEF DESCRIPTION OF THE DRAWINGS

The present invention will be more fully understood and appreciated from the following detailed description, taken in conjunction with the drawings in which.

DETAILED DESCRIPTION OF PREFERRED EMBODIMENTS

Figure 1A:
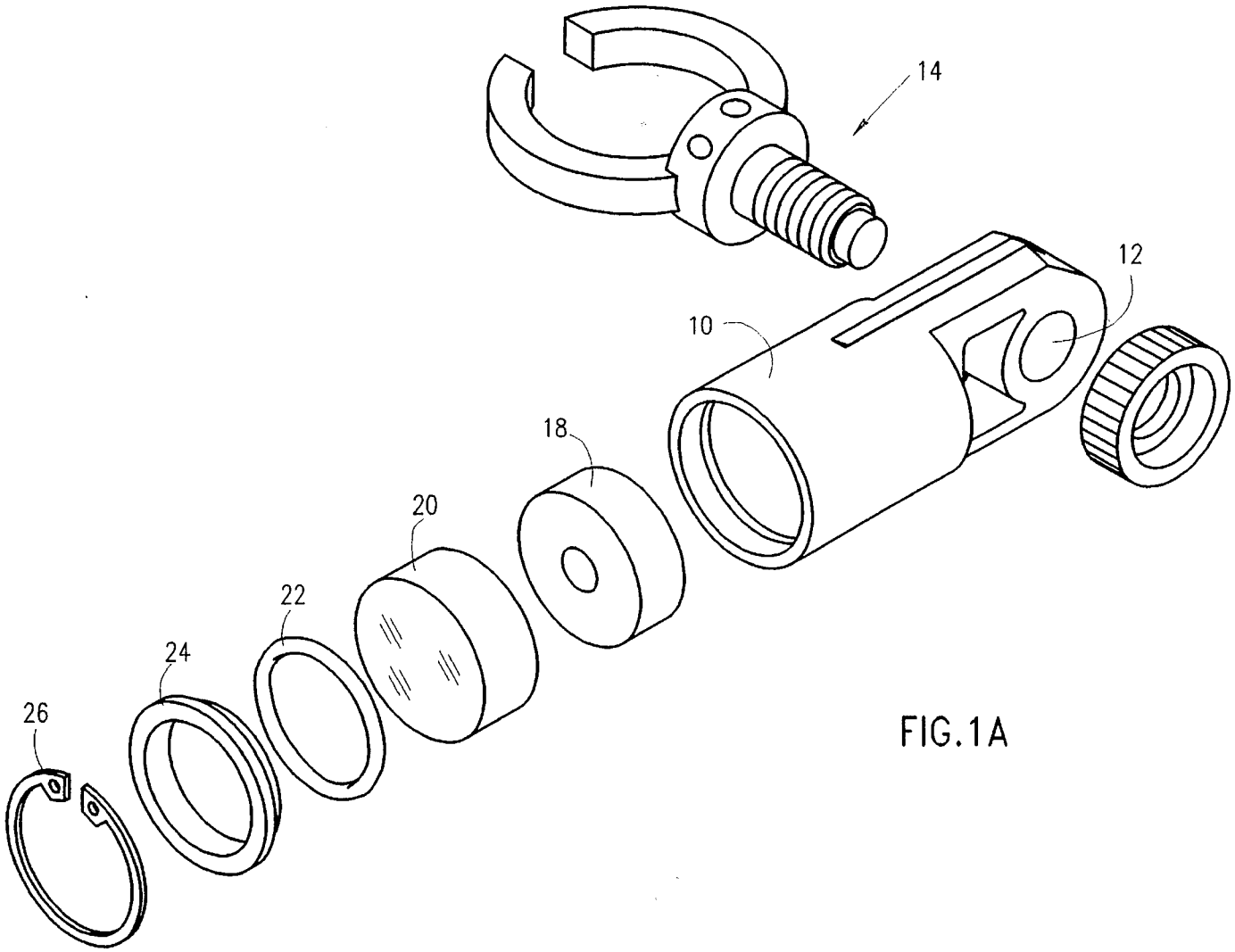
FIGS. 1A and 1B are respective exploded and sectional simplified illustrations of a marker constructed and operative in accordance with a preferred embodiment of the invention.
Figure 1B:
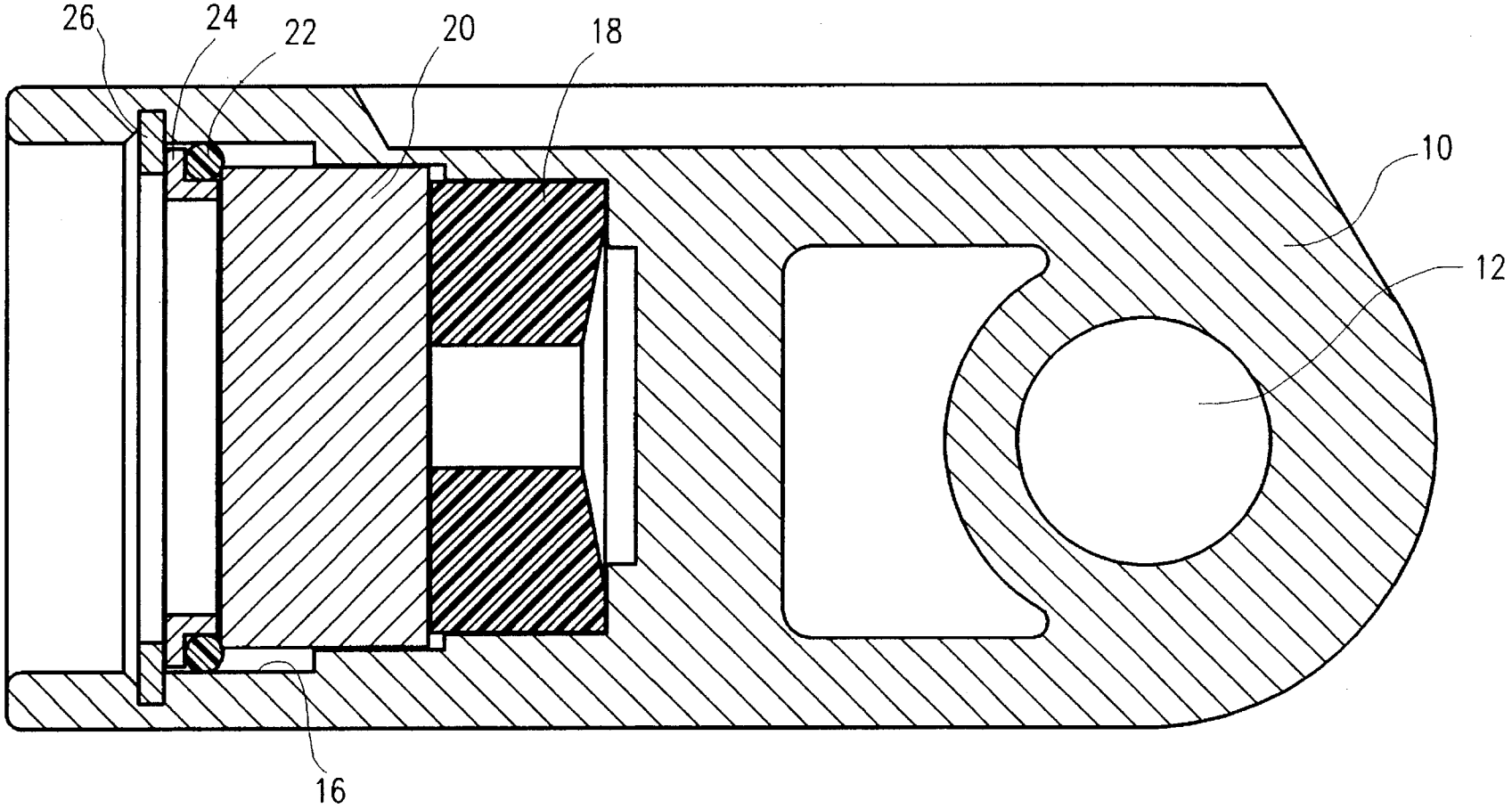

Reference is now made to FIGS. 1A and 1B, which illustrate a marker constructed and operative in accordance with a preferred embodiment of the present invention. The marker comprises a housing 10 which may be formed with an aperture 12 through which may extend one end of a shaft of a mounting clamp assembly 14 for mounting the housing.

Housing 10 which defines a longitudinal axis at one end of which illumination is provided by the tritium light source and at an opposite end thereof the aperture extends transversely thereto and is formed with a multi-step recess 16 in which is disposed a cushion 18, typically formed of an elastomeric material such as rubber and a light module 20, which will be described hereinbelow with reference to FIGS. 2 and 3. The light module 20 is retained in place by an O-ring 22, a metal seal 24 and a metal spring retainer 26.

Figure 2:
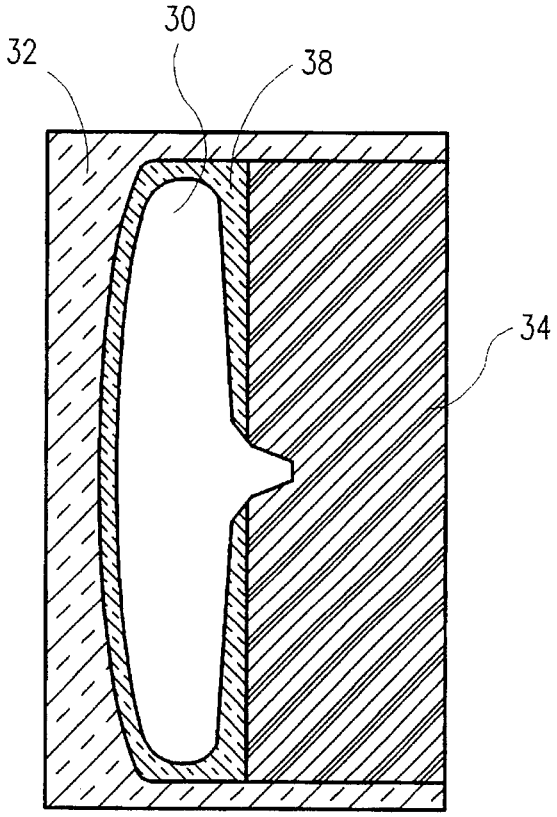
FIG. 2 is a sectional illustration of a light module constructed and operative in accordance with one embodiment of the present invention.

In accordance with one embodiment of the present invention, the light module 20 is constructed and shown in FIG. 2 and comprises a generally disc shaped tritium-filled capsule 30 which is located behind an acrylic housing 32, which is transparent to visible light from the capsule 30, but blocks all other radiation. It is a particular feature of the present invention that a disc shaped capsule 30 is used. Although such disc shaped capsules have been commercially available for quite some time, they have not been used for such applications. Rather, spherical shaped capsules have been employed in the prior art, requiring the use of lenses. The use of lenses is thus obviated in this preferred embodiment.

A layer of optical glue 38 surrounds most of the capsule 30 and a relatively thick layer of white silicon 34 is disposed behind the capsule and acts as a reflector. The enclosure described hereinabove is highly resistant to breakage.

Figure 3:
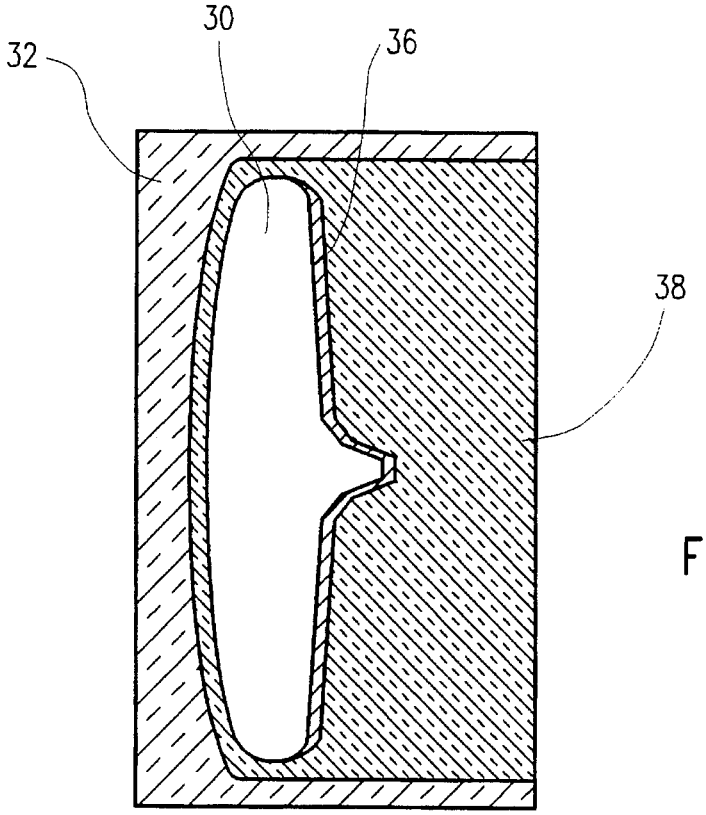
FIG. 3 is a sectional illustration of a light module constructed and operative in accordance with a preferred embodiment of the present invention.

A preferred embodiment of light module 20 is illustrated in FIG. 3 and also comprises a generally disc shaped tritium-filled capsule 30 which is located behind an acrylic housing 32. Here the back of the capsule 30 is coated with white paint 36 and the remainder of the module is filled with optical glue 38.

The use of optical glue provides an enclosure which is highly resistant to breakage and tampering.

It will be appreciated by persons skilled in the art that the present invention is not limited by what has been particularly shown and described hereinabove. Rather the scope of the present invention is defined only by the claims which follow.

I claim:

1. A radioactive marker apparatus including a housing having an aperture;

a mounting clamp having a shaft extending through said aperture; and a lensless light module disposed in the housing; the light module including a generally disc shaded tritium-filled light source capsule disposed in a light source housing.

2. Apparatus according to claim 1 wherein the tritium light source is surrounded on at least one side by optical glue.

3. Apparatus according to claim 2 further comprising white paint is provided on the back surface of the tritium light source to act as a reflector.

4. Apparatus according to claim 3 further comprising white silicon is disposed adjacent the back of the tritium light source to act as a reflector.

5. Apparatus according to claim 2 further comprising white silicon is disposed adjacent the back of the tritium light source to act as a reflector.

6. Apparatus according to claim 1 further comprising white paint is provided on the back surface of the tritium light source to act as a reflector.

7. Apparatus according to claim 6 further comprising white silicon is disposed adjacent the back of the tritium light source to act as a reflector.

8. Apparatus according to claim 1 further comprising white silicon is disposed adjacent the back of the tritium light source to act as a reflector.

9. Apparatus according to claim 1 wherein the housing defines a longitudinal axis at one end of which illumination is provided by said tritium light source and at an opposite end thereof said aperture extends transversely thereto.

10. Apparatus according to claim 1 wherein said housing is an acrylic housing.

* * * * *